US007863821B1

(12) United States Patent
Malkoff

(10) Patent No.: US 7,863,821 B1
(45) Date of Patent: Jan. 4, 2011

(54) DROP-IN LIGHT EMITTING DIODE (LED) MODULE, REFLECTOR, AND FLASHLIGHT INCLUDING SAME

(76) Inventor: Gene Malkoff, 2130 Luther La., Enterprise, AL (US) 36330

( * ) Notice: Subject to any disclaimer, the term of this patent is extended or adjusted under 35 U.S.C. 154(b) by 355 days.

(21) Appl. No.: 12/108,619

(22) Filed: Apr. 24, 2008

Related U.S. Application Data

(63) Continuation-in-part of application No. 11/834,524, filed on Aug. 6, 2007, now Pat. No. 7,633,229.

(51) Int. Cl.
*H01J 13/46* (2006.01)

(52) U.S. Cl. ..... 315/32; 315/33

(58) Field of Classification Search ..... 315/291; 362/362, 364, 365, 366, 367, 368, 372
See application file for complete search history.

(56) References Cited

U.S. PATENT DOCUMENTS

| | | | |
|---|---|---|---|
| 6,481,874 | B2 | 11/2002 | Petroski |
| 6,921,181 | B2 | 7/2005 | Yen |
| 7,008,084 | B2 | 3/2006 | Galli |
| 7,093,954 | B2 | 8/2006 | Sharrah |
| 7,153,004 | B2 | 12/2006 | Galli |
| 2005/0122713 | A1 | 6/2005 | Hutchins |
| 2006/0039139 | A1 | 2/2006 | Maglica et al. |
| 2006/0109655 | A1 | 5/2006 | Martin |
| 2006/0145180 | A1 | 7/2006 | Galli |
| 2006/0146526 | A1 | 7/2006 | Shiau |
| 2007/0081337 | A1 | 4/2007 | Frederico |

OTHER PUBLICATIONS

U.S. Appl. No. 12/207,254, filed Sep. 9, 2008, invented by Gene Malkoff, and entitled "Drop-In Light Emitting Diode (LED) Module and Flashlight Including Same".

Z-Power LED Series Technical Datasheet for W42180, Seoul Semiconductor Co., Ltd, Revised Mar. 2007, pp. 1-16.

500° F. Electrically Resistant Epoxy Datasheet, Cotronics Corporation, 1 page, 2008.

Maxim Low Supply Current, Step-Up DC-DC Converters with True-Shutdown, Maxim Integrated Products, © 2000, pp. 1-13.

Tantalum Surface Mount Capacitor Low Profile, Kemet Electronics Corporation, Oct. 2005, 20 pages.

SMT Power Inductors—LPS4018 Series, Coilcraft, Inc., © 2007, revised May 15, 2007, Documents 435-1 and 435-2, 2 pages.

(Continued)

*Primary Examiner*—Douglas W Owens
*Assistant Examiner*—Jianzi Chen
(74) *Attorney, Agent, or Firm*—Thomas, Kayden, Horstemeyer & Risley, LLP

(57) ABSTRACT

A drop-in light emitting diode (LED) module that can be used to increase the light output of a conventional flashlight includes a heat sink, a high power LED mounted on the heat sink, and an LED driver circuit. The driver circuit is designed to supply the LED with its maximum rated current so that its light output is brighter than the light output of conventional flashlights. The heat sink channels heat generated by the LED when receiving its maximum rated current into the body of the flashlight so the LED does not overheat and fail. The module is designed to be easily inserted into a conventional flashlight to increase its light output and removed when desired. The module can be used to create a modified flashlight by using the module with a conventional reflector that has been modified for use with the module.

13 Claims, 10 Drawing Sheets

OTHER PUBLICATIONS

How to apply Arctic Alumina Premium Ceramic Thermal Adhesive, Arctic Silver, Inc., © 2007, pp. 1-5.

Screenshots of Kemet Tantalum Electrolytic Capacitor, Kemet Part No. T520B476M006ASE070, on sale at Newark Website, http://www.newark.com/jsp/search/productdetail.jsp?SKU=01J3637, 2 pages, 2008.

U.S. Appl. No. 11/834,524, filed Aug. 6, 2007, invented by Gene Malkoff, and entitled "Drop-In Light Emitting Diode (LED) Module, Reflector, and Flashlight Including Same".

DROP-IN LIGHT EMITTING DIODE (LED) MODULE, REFLECTOR, AND FLASHLIGHT INCLUDING SAME

CROSS-REFERENCE TO RELATED APPLICATIONS

The present application is a Continuation-in-Part of U.S. patent application Ser. No. 11/834,524, filed Aug. 6, 2007, invented by Gene Malkoff, and entitled "Drop-In Light Emitting Diode (LED) Module, Reflector, and Flashlight Including Same."

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

REFERENCE TO SEQUENCE LISTING, TABLE, OR COMPUTER PROGRAM LISTING APPENDIX SUBMITTED ON COMPACT DISC AND INCORPORATION-BY-REFERENCE OF MATERIAL ON COMPACT DISC

Not Applicable.

BACKGROUND OF THE INVENTION

1. Field of the Invention

The present invention relates generally to flashlights. More specifically, the present invention relates to a drop-in light emitting diode (LED) module and reflector that can be inserted into a conventional flashlight to increase the light output of the flashlight and create a new modified flashlight.

2. Description of Related Art

Flashlights are well known in the prior art. Examples of existing flashlights are described in U.S. Patent Application Nos. 2006/0109655, published on May 25, 2006 and entitled "Flashlight," 2006/0039139, published on Feb. 23, 2006 and entitled "LED Flashlight," and 2005/0122713, published on Jun. 9, 2005 and entitled "Lighting," and U.S. Pat. Nos. 7,153,004, issued on Dec. 26, 2006 and entitled "Flashlight Housing," 7,093,954, issued on Aug. 22, 2006 and entitled "Flashlight Having LED Assembly and Method for Producing Same," 7,008,084, issued on Mar. 7, 2006 and entitled "Lighting Head Assembly with Integrated Heat Sink," 6,921,181, issued on Jul. 26, 2005 and entitled "Flashlight with Heat-Dissipation Device," and 6,481,874, issued on Nov. 19, 2002 and entitled "Heat Dissipation System for High Power LED Lighting System."

Despite the existence of these and other prior art flashlights, the applicant of the present application was unable to find a flashlight that provided satisfactory performance. In particular, the applicant was unable to find a prior art flashlight that generated a light output that was bright enough for certain applications. As a result, the applicant developed the drop-in LED module and reflector described in detail in this application.

BRIEF SUMMARY OF THE INVENTION

The present invention includes a drop-in LED module that can be inserted into a conventional flashlight to increase the light output of the flashlight. The module includes a heat sink, a high power LED, and an LED driver circuit. The LED is mounted on the heat sink and designed to receive its maximum rated current. The driver circuit is connected to the LED, mounted on the heat sink, and designed to supply the LED with its maximum rated current. The heat sink is designed to be inserted into the flashlight body of the flashlight so that the driver circuit receives power from batteries included in the flashlight and supplies the maximum rated current to the LED. Heat generated by the LED when it receives this current is channeled away from the LED by the heat sink into the flashlight body. The present invention also includes a conventional flashlight reflector modified so that it can be used with the module of the present invention to create a new modified flashlight with a light output that is greater than the light output of conventional flashlights.

The light output generated by the LED of the present invention is brighter than the light output generated by conventional LED flashlights because the LED is supplied with its maximum rated current. The LEDs used in conventional LED flashlights are generally not supplied with their maximum rated currents because they are not properly heatsinked, overheat, and fail. In some prior art LED flashlights, the LEDs are supplied with their maximum rated currents until they begin to overheat, at which time control circuitry in these flashlights reduces the current, and the corresponding light output, to a lower current level in order to prevent the LEDs from overheating. The module of the present invention, however, includes a heat sink that allows the LED used in the present invention to be continually driven at its maximum rated current because it dissipates the heat that would otherwise damage the LED in the flashlight body used with the invention.

DETAILED DESCRIPTION OF THE INVENTION

Figure 1:
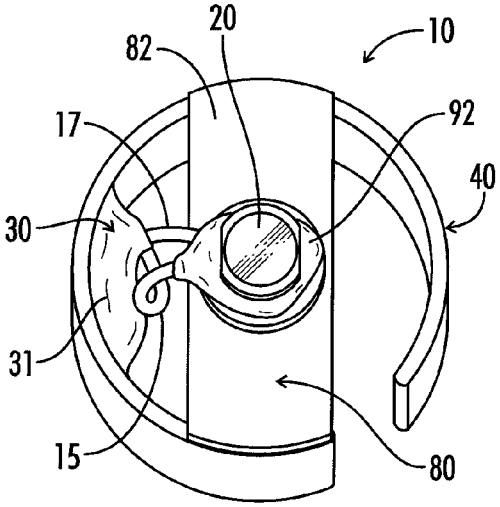
FIG. 1 is a top view of a first embodiment of the drop-in LED module of the present invention.
Figure 2:
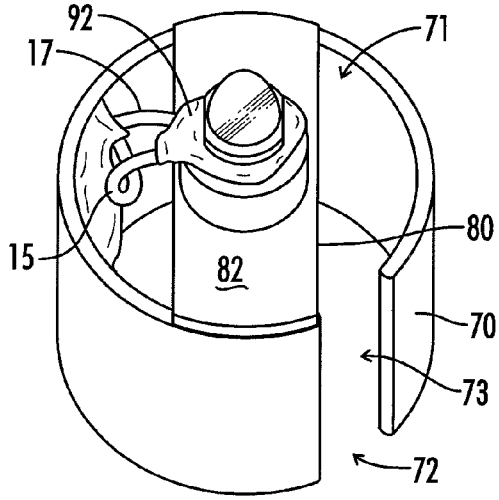
FIG. 2 is a side perspective view of the first embodiment of the present invention shown in FIG. 1.
Figure 3:
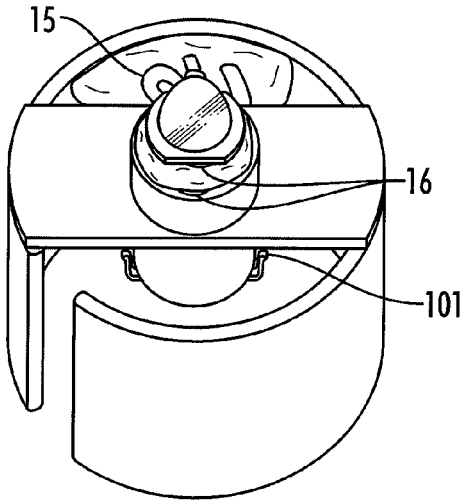
FIG. 3 is a side perspective view of the first embodiment of the present invention shown in FIG. 2 rotated 90 degrees.
Figure 4:
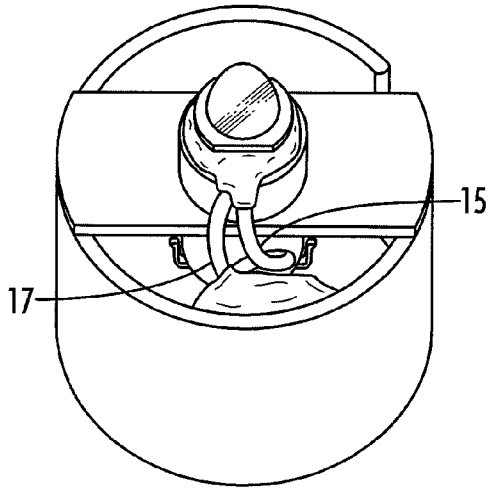
FIG. 4 is a side perspective view of the first embodiment of the present invention shown in FIG. 3 rotated 90 degrees.
Figure 5:
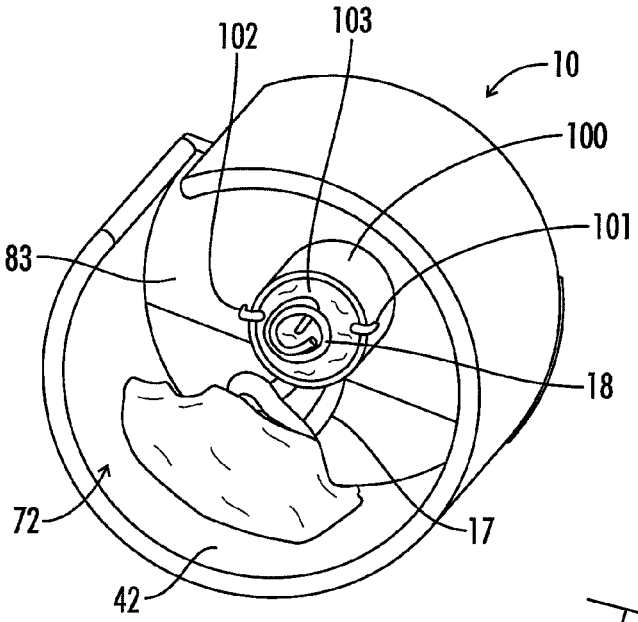
FIG. 5 is a bottom perspective view of the first embodiment of the invention shown in FIG. 1.
Figure 6:
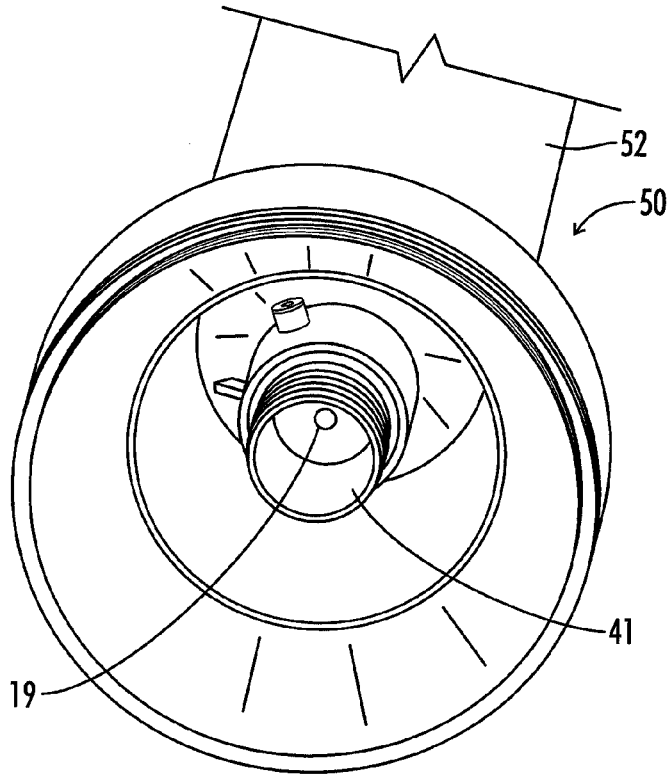
FIG. 6 is a front perspective view of a conventional Maglite flashlight that can be used with the drop-in LED module of the present invention.

Referring to FIGS. 1-5, a first embodiment 10 of the drop-in light emitting diode (LED) module of the present invention includes a high power LED 20, an LED driver circuit 30, and a heat sink 40. LED module 10 is designed to be inserted into a conventional flashlight, such as a conventional Maglite flashlight 50 shown in FIGS. 6 and 7, and to channel heat away from LED 20 into the body 52 of flashlight 50. Module 10 can be quickly and easily inserted into a host flashlight (or moved from one flashlight to another) without damaging the integrity of the flashlight. If a user desires to return the host flashlight to its original configuration, module 10 can also be removed without causing any damage and the original flashlight components can be reinstalled. Module 10 can be inserted into both conventional incandescent, as well as conventional LED flashlights.

In the embodiment shown in FIGS. 1-5, LED 20 is a Seoul Conductor P4 LED that produces an output of 240 lumens when driven with 1000 milliamperes of current. LED 20 is manufactured by Seoul Semiconductor co., Ltd. and is described in detail in a document entitled "Z-Power LED Series, Technical Datasheet for W42180," which is hereby incorporated by reference into the present application.

Figure 13:
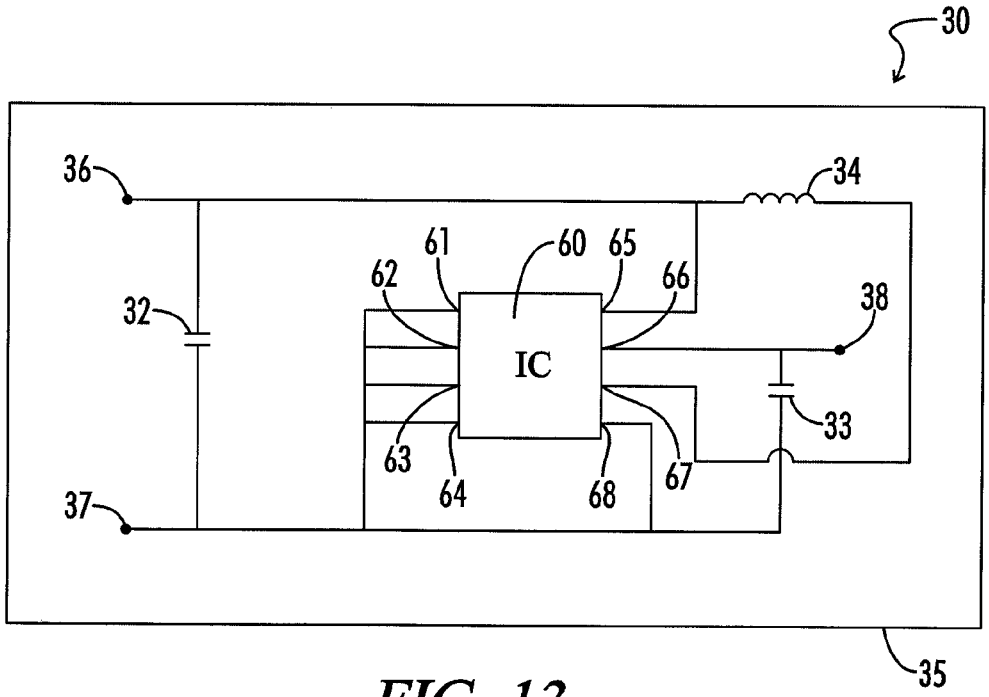
FIG. 13 is a schematic diagram of the LED driver circuit used with one embodiment of the present invention.

LED driver circuit 30, which is shown in FIGS. 1-5 encapsulated with an electrically resistant epoxy 31 but is shown in more detail FIG. 13, is designed to supply LED 20 with its maximum rated current and heat sink 40 is designed to prevent LED 20 from overheating under these circumstances by channeling heat generated by LED 20 into body 52 of flashlight 50. In the embodiment shown in FIGS. 1-5, epoxy 31 is 500° F. Duralco 4525 electrically resistant epoxy manufactured by Cotronics Corporation. Detailed information regarding the 4525 epoxy is described in a document entitled "500° F. Electrically Resistant Epoxy," which is hereby incorporated by reference into the present application.

As shown in FIG. 13, driver circuit 30 includes an integrated circuit (IC) 60, two capacitors, 32 and 33, and an inductor 34, all of which are mounted on a printed circuit board (PCB) 35, a driver positive input 36, a negative input or ground connection 37, and a driver positive output 38. Positive input 36 and ground connection 37 are designed to be connected to the positive and negative outputs, respectively, of a battery or batteries (not shown) typically used in a conventional flashlights. Positive output 38 is designed to be connected to and supply regulated 1000 milliamperes of power to LED 20.

IC 60 includes 8 pin outputs, 61-68. Pin outputs 61-64, and 68 are connected to ground connection 37. Pin output 65 is connected to positive input 36, one end of capacitor 32 and one end of inductor 34. Pin output 67 is connected to the other end of inductor 34. Pin output 66 is connected to positive output 38 and one end of capacitor 33. The other end of capacitor 33 is connected to ground connection 37. Capacitor 32 is connected across positive input 36 and ground connection 37.

In the embodiment shown in FIG. 13, IC 60 is a MAX1797 IC manufactured by Maxim Integrated Products and pin outputs 61-68 correspond to pin outputs 1-8, respectively, of that circuit. Capacitors 32 and 33 are 47 microfarad tantalum electrolytic capacitors manufactured by KEMET Electronics Corporation, and inductor 34 is a 1.1 ampere 10 microhenry inductor manufactured by Coilcraft, Inc. Detailed information regarding the structure and operation of the MAX1797 IC is described in a document entitled "MAXIM, Low Supply Current, Step-Up DC-DC Converters with True-Shutdown" and that document is hereby incorporated by reference into the present application. Detailed information regarding capacitors 32 and 33 is included in a document entitled "Tantalum Surface Mount Capacitor Low Profile" and detailed information regarding inductor 34 is described in a document entitled "SMT Power Inductors-LPS4018 Series." Both of these documents are hereby incorporated by reference into the present application.

Figure 14:
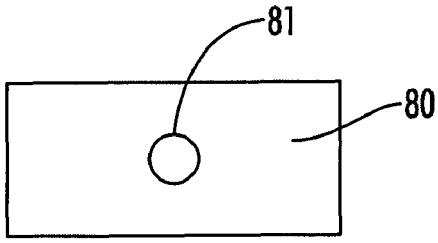
FIG. 14 is a top view of the brace used with one embodiment of the present invention.
Figure 15:
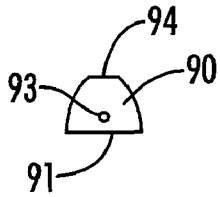
FIG. 15 is a side view of the cap used with one embodiment of the present invention.

Heat sink 40 is designed to provide a thermal path to the body of a flashlight once it has been inserted into that flashlight. It includes a hollow main cylindrical heat sink body 70 having a top opening 71, a bottom opening 72, and a slot 73 extending the length of the body that allows the diameter of body 70 to be compressed. Heat sink 40 also includes a flat, rectangular shaped strap or cross brace 80 connected across top opening 71 of body 70 that includes a top side 82, a bottom side 83 (see FIG. 5), and a brace opening 81 (see FIG. 14) located in its center, a cap 90 (see FIG. 15) mounted on top side 82 of brace 80 having a flat upper surface 94, an open end 91, and a side cap opening 93 located just above open end 91, and a small tube 100 connected to bottom side 83 of brace 80. LED 20 is connected to upper surface 94 using a thermally conductive adhesive 92 so that heat generated by LED 20 is transferred to cap 90. Body 70, brace 80, cap 90, and tube 100 are all thermally conductive, designed to be inserted into a conventional flashlight, such as flashlight 50 shown in FIGS. 6 and 7, and to channel heat away from LED 20 to body 52 of flashlight 50.

Figure 16:
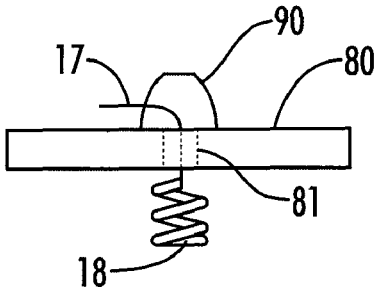
FIG. 16 is a side view showing the cap, brace, brace opening, and spring used with one embodiment of the present invention.

In the embodiment shown in FIGS. 1-5, thermally conductive adhesive 92 is Arctic Alumina Thermal Adhesive manufactured by Arctic Silver, Inc. and is described in detail in a document entitled "Arctic Silver, Instructions for Ceramic Adhesive," which is hereby incorporated by reference into the present application. In addition, main cylindrical body 70 is manufactured out of a 1¼" Type L plumbing tube and is cut into ¾" to 1" lengths. Slot 73 is made by removing a ¼" piece of the sidewall of body 70 and allows the body to be compressed to a smaller diameter of 1.345". Brace 80 is made out of a flattened piece of standard ¾" copper pipe hanger and is brazed across the diameter of body 70 to help it hold its shape. Cap 90 is a standard ¾" copper tube cap that is cut to shorten it by 3/16." Brace opening 81 has a ⅛" diameter and side cap opening 93 has a 3/32" diameter. Cap 90 is brazed to the top center of brace 80, covering brace opening 81 (see FIG. 16). Small tube 100 is a ½" length of 1/14" copper tube that is soldered to the bottom center of brace 80 opposite cap 90. Finally, the resulting heat sink assembly is cleaned and polished with a rotary tool fitted with a wire brush.

Figure 7:
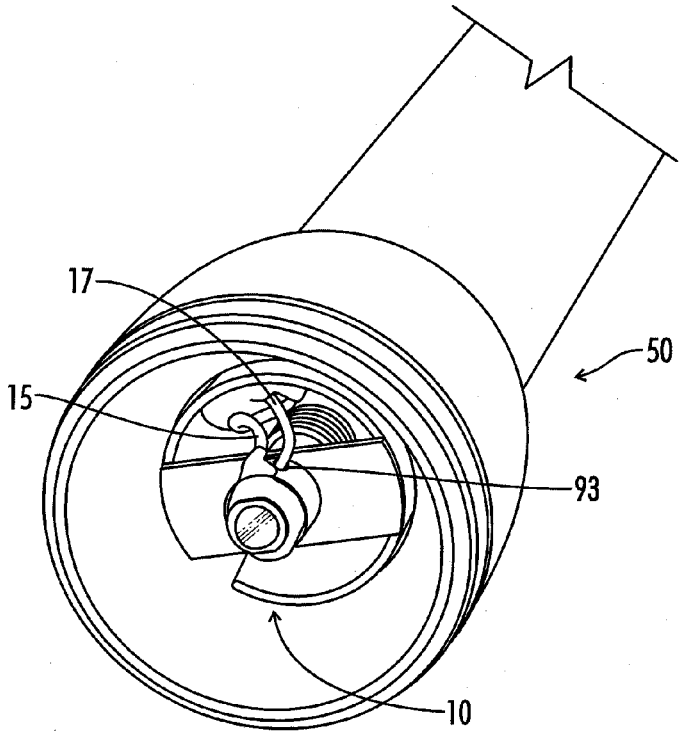
FIG. 7 is a side perspective view of the conventional Maglite flashlight shown in FIG. 6 with the first embodiment of the present invention partially inserted into the flashlight body.
Figure 8:
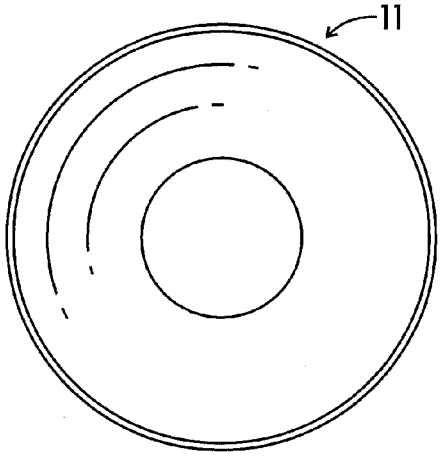
FIG. 8 is a top view of one embodiment of a modified reflector used with the first embodiment of the present invention shown in FIG. 1.
Figure 9:
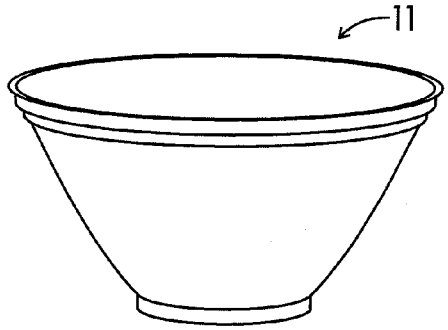
FIG. 9 is a side perspective view of the modified reflector shown in FIG. 8.
Figure 10:
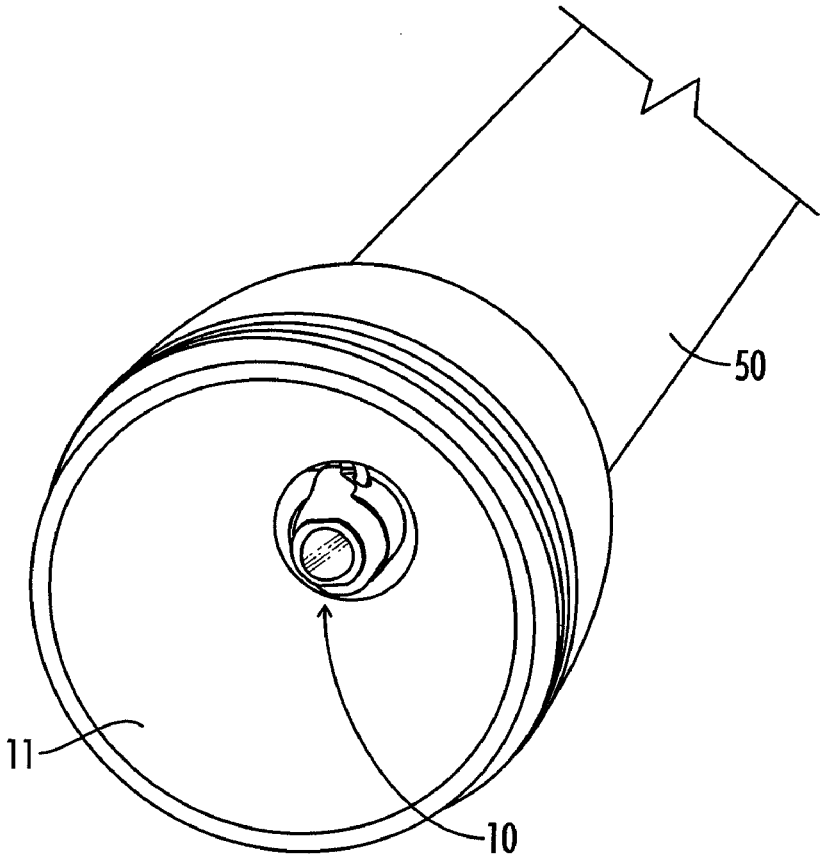
FIG. 10 is a side perspective view of the first embodiment and modified reflector of the present invention inserted into the conventional Maglite flashlight shown in FIG. 6.
Figure 11:
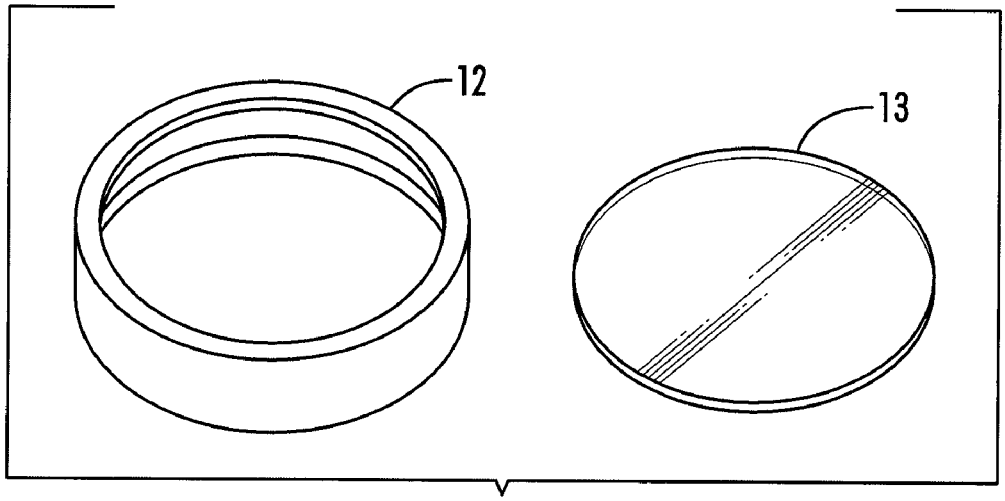
FIG. 11 is a side perspective view of a conventional Maglite flashlight top and lens.
Figure 12:
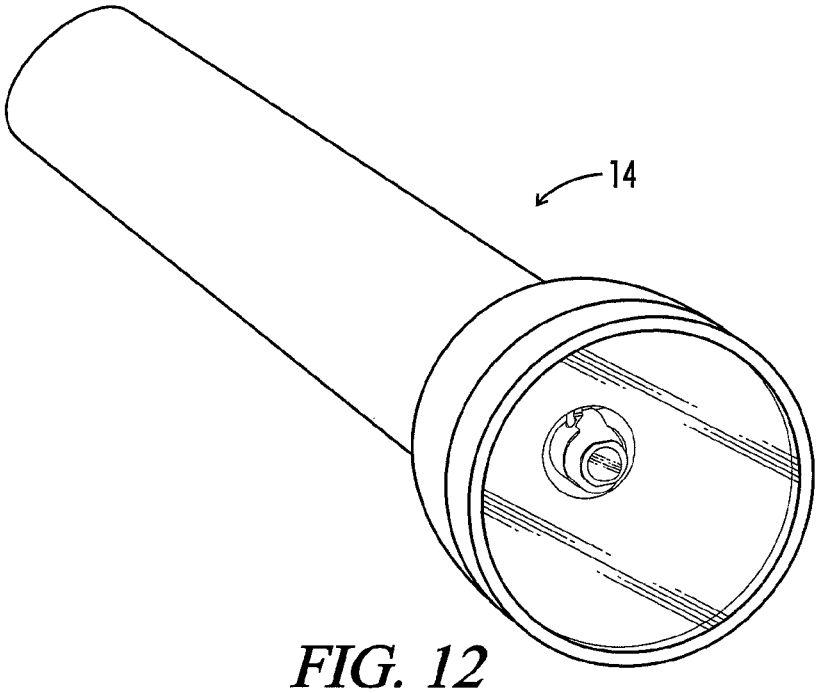
FIG. 12 is a side perspective view of a conventional Maglite flashlight that has been modified to include the first embodiment of the drop-in LED module and the modified reflector of the present invention.

Referring to FIGS. 8-10, module 10 shown in FIGS. 1-5 is designed to be used with a standard Maglite reflector (not shown) that has been modified so that the cam tube, which is included with the reflector, is cut off ⅛" below the curve in the reflector. The resulting modified reflector 11, which is cone-shaped, is shown in FIGS. 8 and 9, and is shown inserted into conventional Maglite flashlight 50 with module 10 discussed previously with regard to FIGS. 1-7. A conventional Maglite flashlight top 12 and lens 13 are shown in FIG. 11 and can be connected to the flashlight 50 shown in FIG. 10 to create a modified Maglite flashlight 14, which is shown in FIG. 12.

Figure 17:
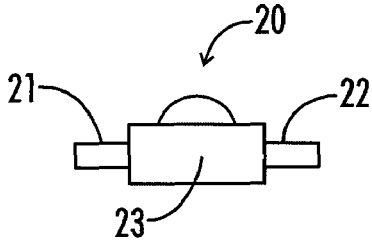
FIG. 17 is a side view of the high power LED used with one embodiment of the present invention.
Figure 18:
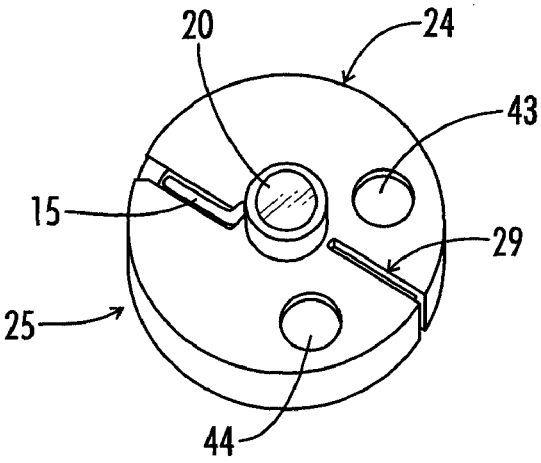
FIG. 18 is a top perspective view of a second embodiment of the drop-in LED module of the present invention.
Figure 19:
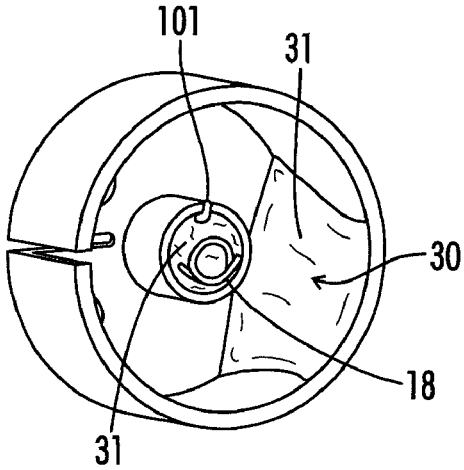
FIG. 19 is a bottom perspective view of the second embodiment shown in FIG. 18.
Figure 20:
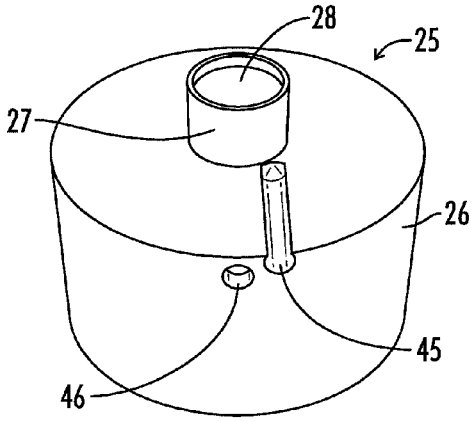
FIG. 20 is a top perspective view of a second embodiment of the heat sink used with the drop-in LED module of the present invention.
Figure 21:
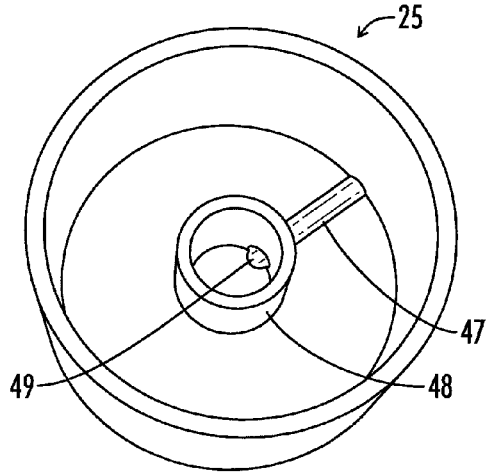
FIG. 21 is a bottom perspective view of the second embodiment of the heat sink shown in FIG. 20.
Figure 22:
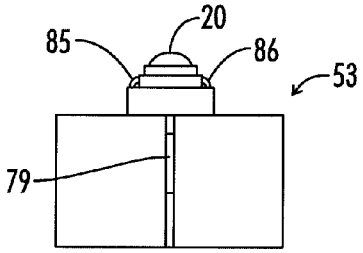
FIG. 22 is a side view of a third embodiment of the drop-in LED module of the present invention.
Figure 23:
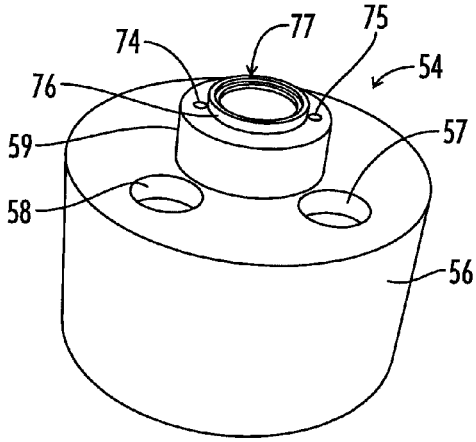
FIG. 23 is a side perspective view of a third embodiment of the heat sink used with the drop-in LED module of the present invention.
Figure 24:
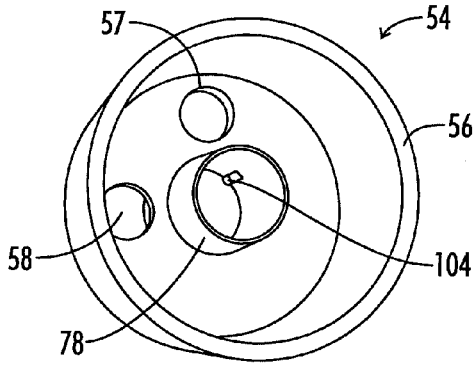
FIG. 24 is a bottom perspective view of the third embodiment of the heat sink shown in FIG. 23.
Figure 25:
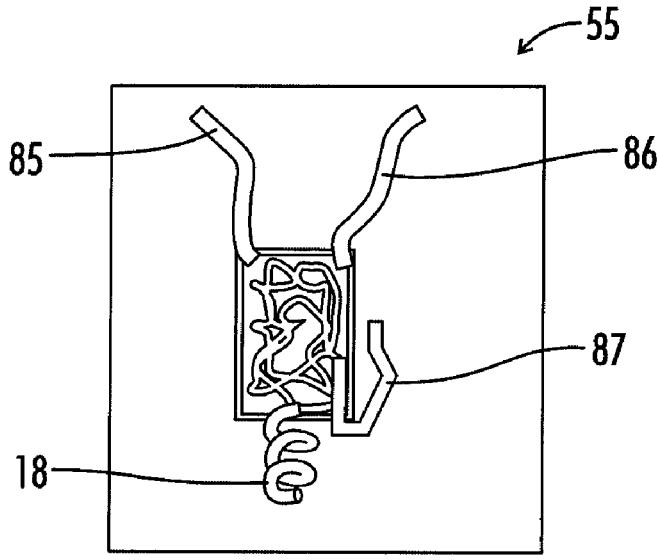
FIG. 25 is a drawing of a second embodiment of the LED driver circuit for the drop-in LED module of the present invention.
Figure 26:
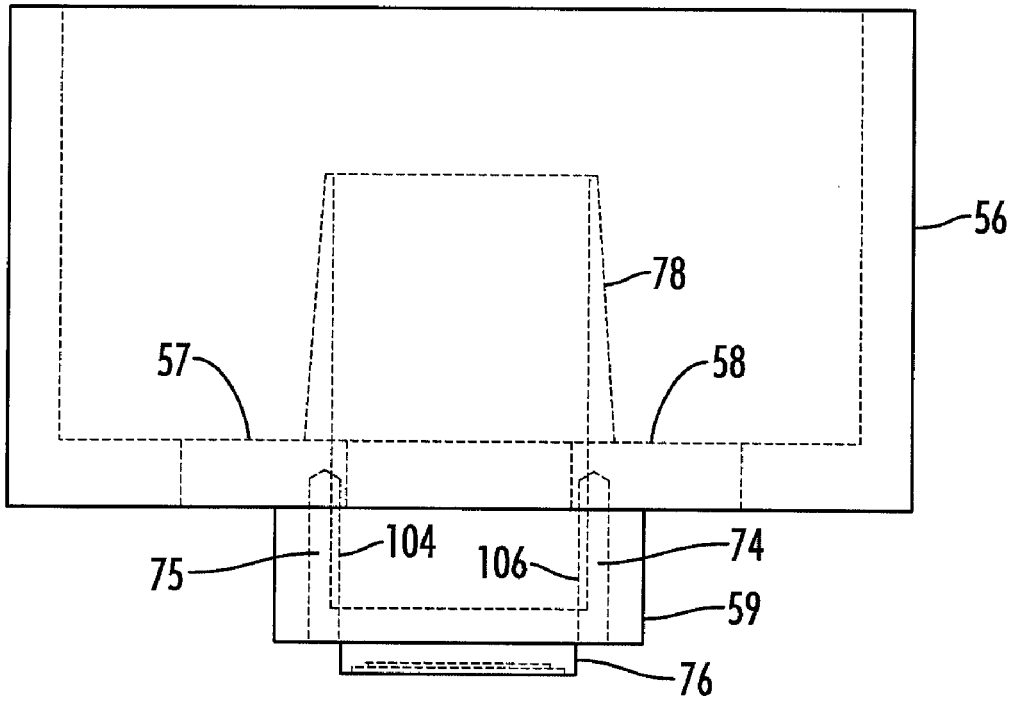
FIG. 26 is a hidden line drawing view of the third embodiment of the heat sink shown in FIG. 23.
Figure 27:
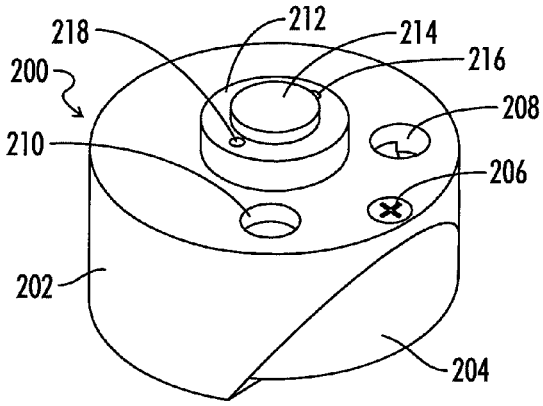
FIGS. 27-28 are perspective views of still another embodiment of a heat sink that can be used with the drop-in LED module of the present invention.
Figure 28:
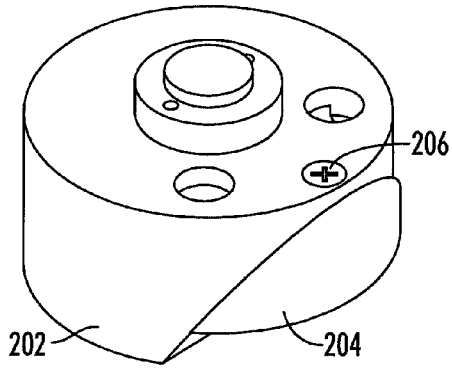
Figure 29:
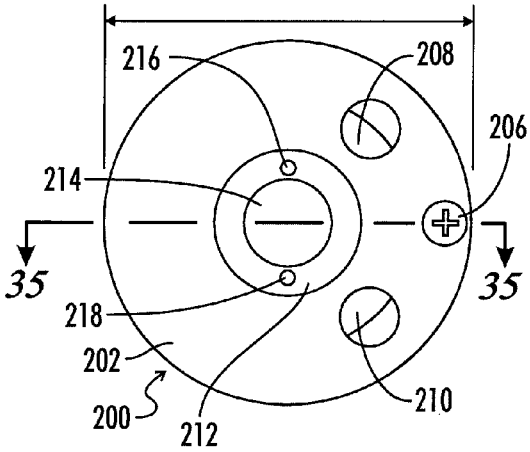
FIGS. 29-30 are top views of the heat sink shown in FIGS. 27-28.
Figure 30:
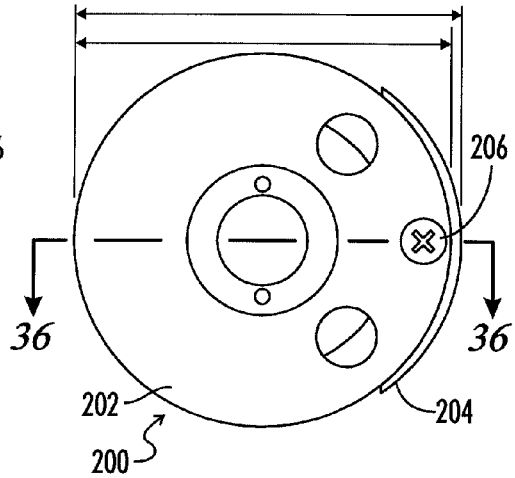

LED 20 (see FIG. 17) includes a positive input 21, a negative input or LED ground connection 22, and an LED body 23. Positive input 21 is connected to positive output 38 of LED driver circuit 30 using a wire 15 (see FIGS. 7 and 13) and LED ground connection 22 is connected to the side of cap 90 using solder 16. Positive input 36 of driver circuit 30 is connected to the positive output of the batteries included in flashlight 50 (FIG. 7) using a wire 17 and a spring 18. Wire 17 is connected to positive input 36, extends through side cap opening 93 (see FIGS. 7 and 16), passes through brace opening 81, and is connected to spring 18. Spring 18, in turn, when inserted into flashlight 50 as shown in FIG. 7, connects to flashlight positive output 19 (FIG. 6) of the batteries included in flashlight 50.

Driver circuit ground connection 37 connects to the negative output of the batteries in flashlight 50 in the following manner. When module 10 is inserted into flashlight 50 (see FIGS. 5-7), small tube 100 engages with flashlight ground tube 41, which is connected to the negative output of the flashlight batteries, and forms an electrical connection between ground connection 37 and the negative output of these batteries. Ground connection 37 is soldered to an inner surface 42 (see FIG. 5) of main body 70 of heat sink 40, main body 70 is connected to brace 80, and brace 80 is connected to small tube 100. Thus, when small tube 100 is connected to flashlight ground tube 41, heat sink 40 is grounded and serves as the ground connection for driver circuit 30. Small tube 100 includes wires 101 and 102 (FIG. 5) to facilitate the connection between small tube 100 and flashlight ground tube 41. To electrically isolate spring 18 from small tube 100 and prevent a short from occurring, small tube 100 is filled with electrically resistant epoxy 103 (FIG. 5) so that it encapsulates spring 18. This prevents spring 18 from making electrically contact with small tube 100, which is negative with respect to spring 18 and serves as the ground connection for driver circuit 30.

In one embodiment, epoxy 103 is the Duralco 4525 epoxy used to encapsulate driver circuit 30 and discussed previously, wires 15 and 17 are 22 gauge hookup wires, and spring 18 is a phosphor bronze spring.

A second embodiment 24 of the drop-in LED module of the present invention is shown in FIGS. 18-21. This embodiment is similar to first embodiment 10 and, other than the use of a different heat sink 25 which will be described in more detail below, operates and functions in the same manner as first embodiment 10. Second embodiment 24 includes LED 20, LED driver circuit 30 and spring 18, both of which are encapsulated with electrically resistant epoxy 31, wire 101 for facilitating the connection between heat sink 25 and flashlight ground tube 41, and wire 15, which connects positive output 38 of driver circuit 30 to positive input 21 of LED 20.

Heat sink 25 (FIGS. 20-21) includes a hollow cylindrical heat sink body 26 having a closed end 88, a upper LED support portion 27 that includes a recess 28, slot 29, top openings 43 and 44, an inner channel 45, a side opening 46, a lower channel 47, and an inner cylindrical portion 48 having wire opening 49. Heat sink body 26, upper LED support portion 27, and inner cylindrical portion 48 are manufactured out of copper like heat sink 40 discussed previously. Recess 28 in upper LED support portion 27 is sized to receive LED 20, which is connected to support portion 27 using thermally conductive adhesive 92 used to the connect LED 20 to heat sink 40. Slot 29, like slot 73 in first embodiment 10, allows the diameter of heat sink 25 to be adjusted so that it can fit tightly into a conventional flashlight. Top openings 43 and 44 allow second embodiment 24 to be easily removed from a conventional flashlight using a pair of pliers. Upper channel 45 is designed to receive wire 15, which passes through side opening 46 and connects positive input 21 of LED 20 to output 38 of LED driver circuit 30. Negative input or ground connection 22 of LED 20 is soldered to the side of upper support portion 27. Inner channel 47 is designed to receive wire 17, which passes through wire opening 49 and connects to spring 18.

A third embodiment 53 of the drop-in LED module of the present invention is shown in FIGS. 22-26. Third embodiment 53, like second embodiment 24 is similar to first embodiment 10 and, other than the use of a different heat sink 54 and driver circuit 55, both of which will be described in more detail below, operates and functions in the same manner as first embodiment 10.

Heat sink 54 includes a hollow cylindrical body 56 having a closed end 89, top openings 57 and 58, a first LED support portion 59, which includes wire openings 74 and 75, and a second LED support portion 76 that includes a layered recess 77. Heat sink 54 also includes a slightly cone shaped inner portion 78, slot 79, and vertical channels 104 and 106 (see FIG. 26) defined in inner portion 78. Cylindrical body 56, first LED support portion 59, and second LED support portion 76 are manufactured out of copper but can also be manufactured out of aluminum as well. Top openings 57 and 58 allow third embodiment 53 to be easily removed from a conventional flashlight using pliers or similar tools. Slot 79 allows the diameter of heat sink 54 to be compressed so that it fits tightly when it is inserted into a conventional flashlight.

Driver circuit 55 functions and operates in the same manner as driver circuit 30 discussed previously but is assembled and connected together in a slightly different manner. Driver circuit 55 includes PCB 35, a positive LED wire 85, negative LED wire 86, a clip 87, and spring 18. Driver circuit 55 is designed to be inserted into and clipped to inner portion 78 using clip 87. Driver circuit 55 is also designed to be encapsulated (not shown) with electrically resistive epoxy 31 inside inner portion 78. Positive LED wire 85 is designed to be passed through vertical channel 106 defined in inner portion 78 and extended upward out of wire opening 74. Negative LED wire 86 is designed to be passed through vertical channel 104 and extended upward out of wire opening 75.

Third embodiment 53 includes LED 20, which is mounted on heat sink 54 using layered recess 77 and thermally conductive adhesive 92. Positive LED wire 85 is connected to positive input 21 of LED 20 and positive output 38 of driver circuit 55 (the schematic for driver circuit 55 is the same as the schematic for driver circuit 30 shown in FIG. 13 and includes the same positive output 38). Negative LED wire 86 is connected to ground connection 22 of LED 20 and clip 87. When third embodiment 53 is inserted into a conventional flashlight, such as flashlight 50 (FIG. 6), inner portion 78 connects with flashlight ground tube 41 and grounds heat sink 54.

Still another embodiment of a heat sink that can be used with the drop-in LED module of the present invention is shown in FIGS. 27-38. As shown in these figures, heat sink 200 includes a main body 202 and a wedge-shaped piece 204 adjustably connected to main body 202 using a screw 206. Main body 202 is cylindrical in shape and is manufactured out of the same materials used to manufacture the various embodiments of the heat sink previously discussed above. Wedge-shaped piece 204 is manufactured out of the same materials.

Figure 31:
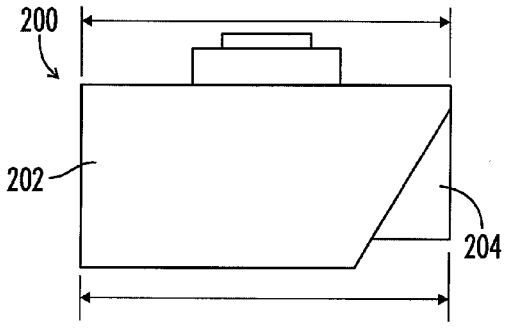
FIGS. 31-32 are side views of the heat sink shown in FIGS. 27-28.
Figure 32:
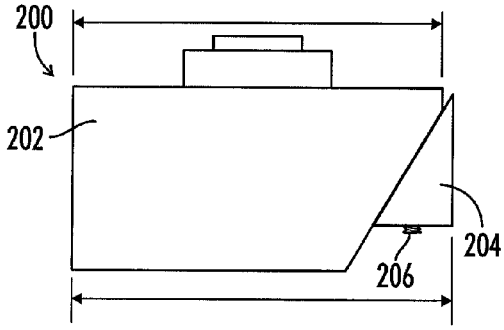
Figure 33:
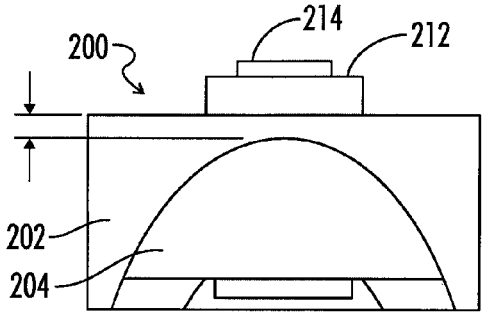
FIGS. 33-34 are side views of the heat sink shown in FIGS. 31-32 rotated 90 degrees clockwise.
Figure 34:
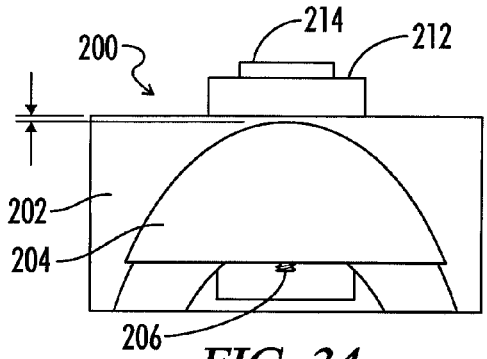
Figure 35:
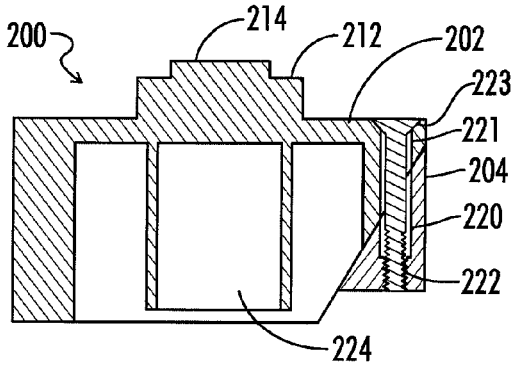
FIGS. 35-36 are cut away views of the heat sink shown in FIGS. 31-32.
Figure 36:
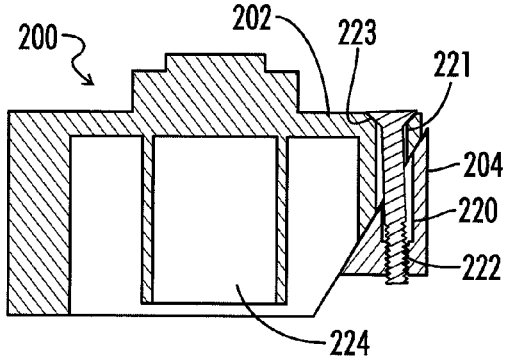
Figure 37:
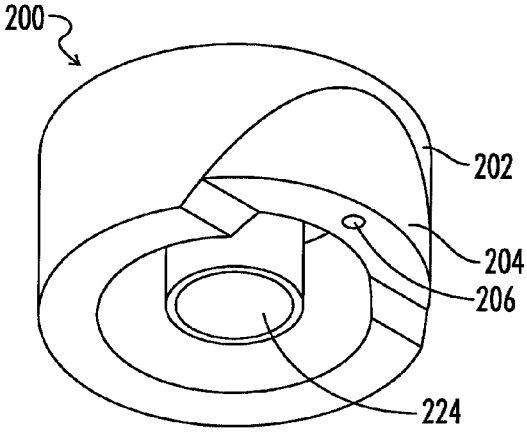
FIGS. 37-38 are perspective bottom views of the heat sink shown in FIGS. 27-28.
Figure 38:
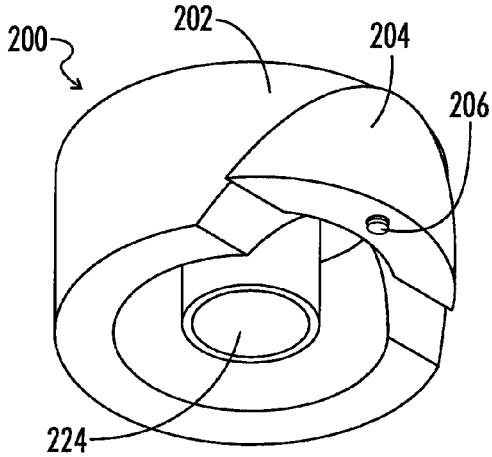

When screw 206 is rotated in one direction, wedge-shaped piece 204 moves up with respect to and out away from main body 202 as shown in FIGS. 31-32. This allows heat sink 200 to be inserted into a flashlight body and then adjusted so that it fits snugly. Similarly, when screw 206 is rotated in the opposite direction, wedge-shaped piece 204 moves down with respect to and inward toward main body 202. This allows heat sink 200 to be loosened so that it may be removed from a flashlight body.

Main body 202 may include two openings, 208 and 210 (see FIGS. 29-30), that can be used to remove heat sink 200 from a flashlight body using pliers. Main body 202 may also include first and second support portions, 212 and 214. Both are cylindrical in shape and first support portion 212 includes wire openings, 216 and 218, that allow wires to pass through as discussed previously with respect to other heat sink embodiments. Second support portion 214 is designed to receive and support an LED as previously discussed with respect to other heat sink embodiments.

Wedge-shaped piece 204 includes an opening 220 and a threaded portion 222 (see FIGS. 35-36), both of which are designed to receive screw 206. Main body 202 may be hollow and may include a hollow cylindrical inner portion 224 (FIGS. 37-38), which is designed to receive driver circuit 55 as discussed previously with respect to other heat sink embodiments. Main body 202 may also include an opening 221 having a beveled portion 223, both of which are designed to receive screw 206.

In summary, heat sink 200 is similar to heat sink 54 discussed above except that it does not include a slot. Instead, heat sink 200 includes wedge-shaped piece 204 that can be used to adjust heat sink 200 so that it can be inserted into and removed from a flashlight body. Heat sink 200 also does not include layered recess 77 included with heat sink 54.

The above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

What is claimed is:

1. A drop-in light emitting diode (LED) module for a flashlight, comprising:

a heat sink including an adjustable portion to facilitate insertion and removal of the heat sink from a flashlight having a flashlight body, the heat sink including an elongated, hollow, cylindrical main body, a first cylindrical support portion connected to the main body, and a second cylindrical support portion connected to the first cylindrical support portion, the first cylindrical support portion including a pair of wire openings defined therein and the second cylindrical support portion being positioned in between the wire openings;

a high power LED mounted on the heat sink and designed to receive a maximum rated current;

an LED driver circuit connected to the high power LED and mounted on the heat sink, the LED driver circuit designed to supply the maximum rated current to the high power LED when the drop-in LED module is inserted into the flashlight and power is supplied to the LED driver circuit using batteries included in the flashlight; and wherein the heat sink is designed to be inserted into the flashlight body so that the LED driver circuit receives power from the batteries included in the flashlight and supplies the maximum rated current to the high power LED and heat generated by the high power LED when receiving the maximum rated current is channeled away from the high power LED into the flashlight body.

2. The module of claim 1, wherein the adjustable portion is wedge-shaped and connected to a main body of the heat sink using a screw, the second cylindrical support portion has a second diameter, and the first cylindrical support portion has a first diameter that is greater than the second diameter of the second cylindrical support portion.

3. The module of claim 2, wherein the main body includes a main body screw opening having a beveled portion for receiving the screw and a hollow cylindrical inner portion for receiving the LED driver circuit.

4. The module of claim 3, wherein the adjustable portion of the heat sink includes an adjustable portion screw opening having a threaded portion for receiving the screw.

5. The module of claim 1, wherein the heat sink has a diameter and the adjustable portion may be moved upward and outward away from a main body of the heat sink, thereby increasing the diameter of the heat sink, or downward and inward toward a the main body of the heat sink, thereby decreasing the diameter of the heat sink.

6. The module of claim 1, wherein the second cylindrical support portion has a second diameter, and the first cylindrical support portion has a first diameter that is greater than the second diameter of the second cylindrical support portion.

7. The module of claim 6, wherein the main body includes two openings that can be used to facilitate removing the heat sink from a flashlight body.

8. The module of claim 1, wherein:

the high power LED is mounted to the heat sink using a thermally conductive adhesive that electrically isolates the high power LED from the heat sink and allows heat generated by the high power LED to be transferred to the heat sink.

9. A flashlight, comprising:

a flashlight body;

a drop-in light emitting diode (LED) module inserted into the flashlight body, the drop-in LED module including a high power LED designed to receive a maximum rated current, an LED driver circuit connected to the high power LED and designed to supply the maximum rated current to the high power LED, and an adjustable heat sink connected to the high power LED and the flashlight body and designed to channel heat generated by the high power LED away from the high power LED into the flashlight body, the adjustable heat sink including a main body and an adjustable portion adjustably connected to the main body such that the adjustable portion can be moved with respect to the main body to increase or decrease a diameter of the adjustable heat sink, the main body having an elongated, hollow, cylindrical shape and including a hollow cylindrical inner portion within which the LED driver circuit is disposed and the adjustable heat sink including a first cylindrical support portion connected to the main body and a second cylindrical support portion connected to the first cylindrical support portion, the first cylindrical support portion having a first diameter that is greater than a second diameter of the second cylindrical support portion, the first cylindrical support portion including a pair of wire openings defined therein and the second cylindrical support portion being positioned in between the wire openings;

a cone-shaped reflector inserted into the flashlight body adjacent to the drop-in LED module;

a lens inserted into the flashlight body adjacent to the reflector; and a lens cap connected to the flashlight body adjacent to the lens.

10. The flashlight of claim 9, wherein the adjustable portion includes a wedge-shaped portion adjustably connected to the main body.

11. The flashlight of claim 10, wherein the wedge-shaped portion is adjustably connected to the main body using a screw.

12. The flashlight of claim 11, wherein the main body includes a main body screw opening having a beveled portion for receiving the screw.

13. The flashlight of claim 12, wherein the wedge-shaped portion includes a wedge-shaped portion screw opening having a threaded portion for receiving the screw.

* * * * *